United States Patent [19]

Much

[11] 3,975,858

[45] Aug. 24, 1976

[54] TOY CONSTRUCTION FABRICATING MEMBER AND ASSEMBLAGE

[76] Inventor: Joe Much, 1000 N. Lake Shore Drive, Chicago, Ill. 60611

[22] Filed: Aug. 29, 1974

[21] Appl. No.: 501,751

[52] U.S. Cl. ..... 46/26; 46/16; 46/29

[51] Int. Cl.[2] ..... A63H 33/10

[58] Field of Search ..... 46/16, 17, 22, 26, 27, 46/28, 29

[56] References Cited

UNITED STATES PATENTS

| | | | |
|---|---|---|---|
| 1,216,840 | 2/1917 | Ramsey et al. | 46/26 |
| 2,100,658 | 11/1937 | Finch | 46/26 |
| 2,225,612 | 12/1940 | Allen | 46/26 X |
| 2,662,335 | 12/1953 | Calverley | 46/28 X |
| 3,360,883 | 1/1968 | Glanzer | 46/29 |
| 3,464,147 | 9/1969 | Fischer | 46/26 |

FOREIGN PATENTS OR APPLICATIONS

| | | | |
|---|---|---|---|
| 1,246,185 | 10/1960 | France | 46/29 |
| 214,821 | 5/1924 | United Kingdom | 46/16 |

*Primary Examiner*—F. Barry Shay
*Attorney, Agent, or Firm*—Dressler, Goldsmith, Clement & Gordon, Ltd.

[57] ABSTRACT

A toy construction system incorporating fabricating members each defining a plurality of bores and holes, a large number of which holes and bores are provided with expansion slits which permit easy insertion and removal of rods and tubes in the holes and bores and which serve to enable the holes and bores to act resiliently when a rod or tube is inserted. The rods and tubes are preferably flexible, thereby to facilitate the making of assemblages which have a highly contoured or sculptured look.

8 Claims, 13 Drawing Figures

TOY CONSTRUCTION FABRICATING MEMBER AND ASSEMBLAGE

This invention relates to improved toy construction elements and to assemblies fabricated with such elements. The assemblies and elements are especially adapted for use by children who may use them to produce various types of structures, including structures having a sculptured or contoured appearance.

A wide variety of building block and building block systems have been described in the literature and are available for use. Each of these has its advantages and each has its drawbacks.

The construction system of this invention makes it possible to create models and designs of varying shapes and contours so that the models and assemblages made are limited only by the user's imagination. The novel fabricating members of this invention, when combined with flexible connecting members, provide model and toy construction possibilities which are unequaled by toy construction systems now available for use.

In accordance with this invention, toy construction elements are provided which comprise fabricating members defining a plurality of bores and holes, a large number of which define expansion slits which permit easy insertion and removal of rods or tubes in the holes and bores and which serve to enable the holes and bores to act resiliently by widening when a connector rod or tube is inserted and which permit the holes and bores to return to their original size when the connector rods or tubes are removed. the provision of these slits make it possible to use connector rods or tubes which need not necessarily be of close tolerances or of highly machined precision.

The fabricating members of this invention are especially adapted for assembly with flexible rods or tubes which enable the user to produce assemblages which have a highly contoured or sculptured look. This enables the user not only to erect and build conventional types of devices with conventionally shaped blocks or elements, but also permits the user to produce contoured or sculptured three-dimensional objects, serving thereby to challenge the artistic bent of the users of the fabricating members and assemblage. Because of the flexibility permitted in accordance with this invention, the fabricating members and assemblages also have potential use by scientists and artists.

These and othe objects and advantages of this invention will become apparent from the following description and drawings of which:

Figure 7:
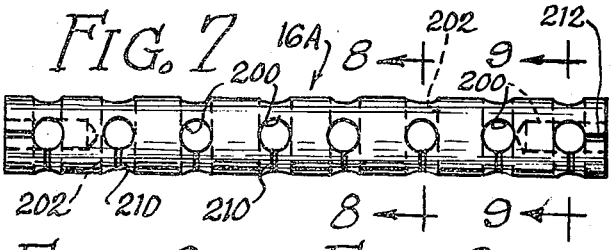
FIG. 7 illustrates a further fabricating member of this invention.
Figure 8:
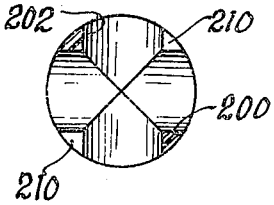
Figure 9:
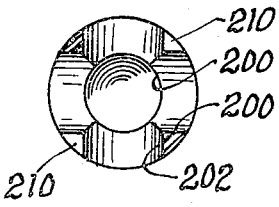

FIGS. 8 and 9 are cross-sectional views taken substantially along the lines 8—8 and 9—9, respectively of FIG. 7.

Figure 1:
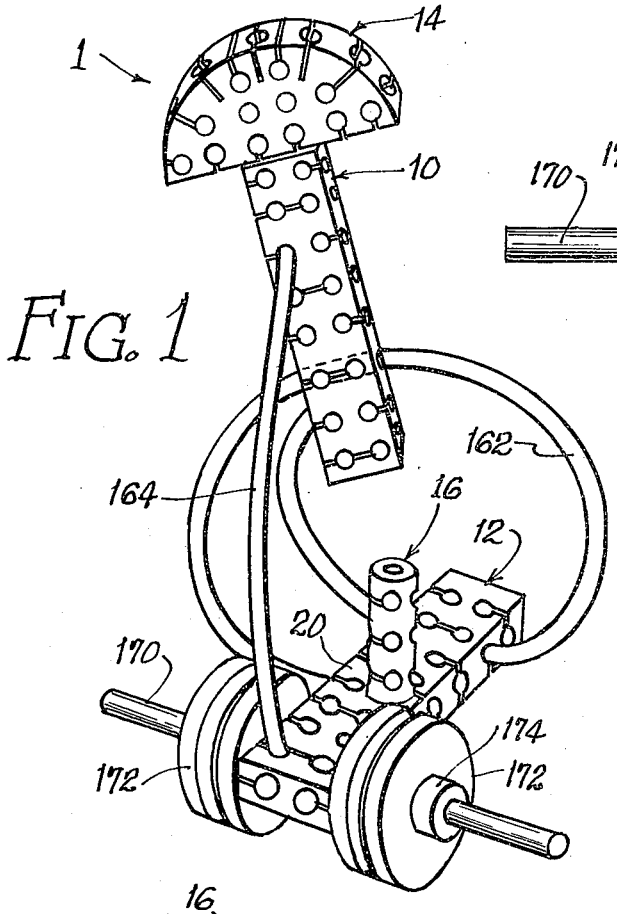
FIG. 1 shows a plurality of fabricating members of this invention joined together to form a contoured artistic assemblage.

Referring now to the drawings, a typical fabricated assemblage of this invention is shown in FIG. 1 to include a plurality of typical fabrication members linked together by flexible rods which are received in holes and bores in the members.

Assemblage 1 comprises a first construction member 10, a second such member 12, and third and fourth members 14 and 16. These members may be made of plastic or wood or of other suitable material. In the illustrated embodiment they are formed of a transparent plastic which is suitably drilled and slotted to the forms illustrated. Members 10 and 12, in this embodiment, are identical and, accordingly, only one will be described in detail.

Element 12 is a rectangular parallelepiped. It has two major parallel surfaces 20 and 22 and a perimeter, in this case having side edges 24 and 26 and end edges 28 and 30.

Member 12 defines a plurality of generally cylindrical bores 32 which extend clear through the member 12 and which open at each of the surfaces 20 and 22. In the embodiment illustrated, there are two columns of such bores 32, although they need not necessarily be so arranged.

Member 12 also defines a plurality of generally cylindrical holes 34. Holes 34 open at the perimeter, in edges 24, 26, 28 and 30, and extend inwardly from their associated edges. In some cases they extend clear through the element 12, as illustrated by holes 34A. In other cases they extend inwardly from an associated edge, only partially toward an opposite edge, as is illustrated by holes 34B. In each case the holes 34A and 34B lie between major surfaces 20 and 22 and each lies along an axis which is generally parallel to the major surfaces 20 and 22. In the embodiment illustrated some of the holes and bores intersect, generally at right angles.

In accordance with this invention substantially each hole and bore is designed to expand somewhat, more firmly and resiliently to grip and hold complementary rods or tubes to be inserted in the holes and bores and to accommodate rods and tubes which may be oversized, thereby to minimize the necessity of maintaining excessively close tolerances for tubes and rods to be used with the fabricating members to fashion assemblages in accordance with this invention.

To that end, substantially each hole and bore is provided with a cooperating slit which intersects a surface into which the bore of hole opens and which also communicates with its respective bore or hole. Each slit is effectively at least half the length of its associated hole or bore and each extends inwardly to the bore or hole from a surface of the member.

Figure 2:
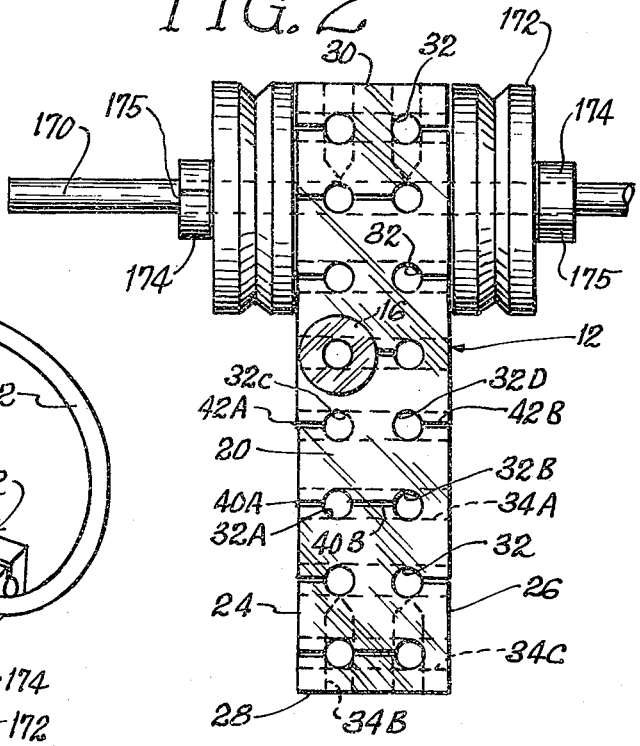
FIG. 2 is a plan view of a portion of the assemblage of FIG. 1.
Figure 3:
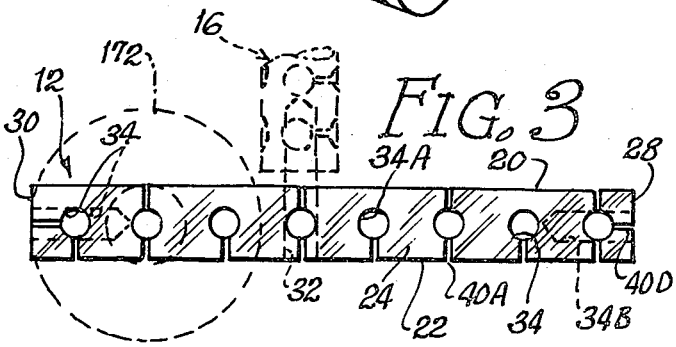
FIG. 3 is a side elevational view of a portion of the assemblage of FIG. 1.
Figure 4:
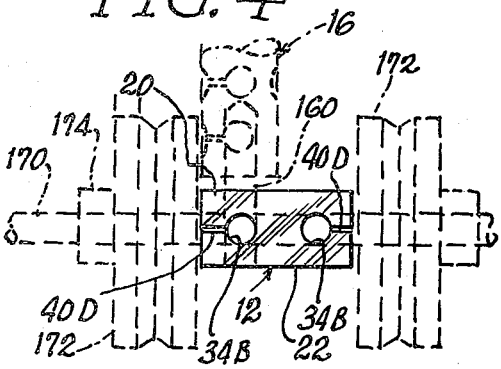
FIG. 4 is an end elevational view of a portion of the assemblage of FIG. 1.
Figure 2A:
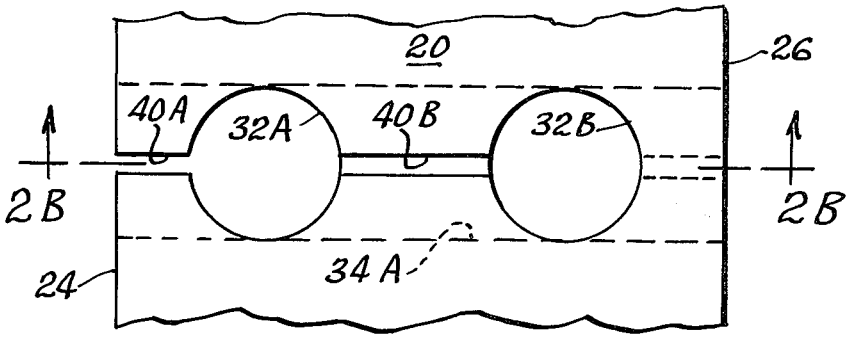
FIG. 2A is an enlarged fragmentary view of FIG. 2.
Figure 2B:
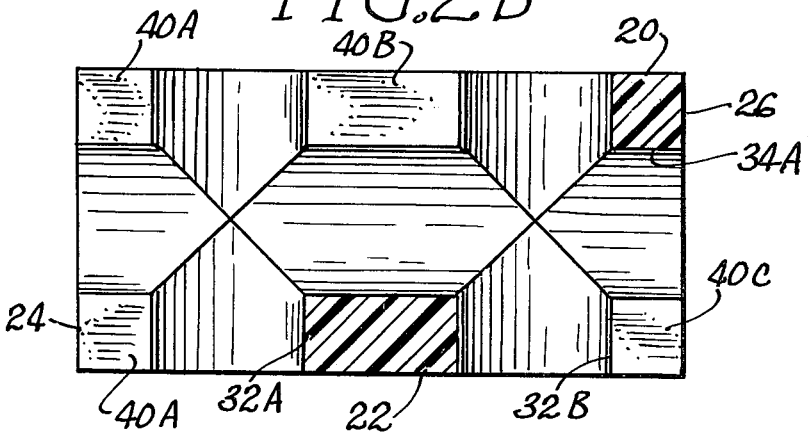
FIG. 2B is a cross-sectional view taken substantially along the line 2B—2B of FIG. 2A.
Figure 2C:
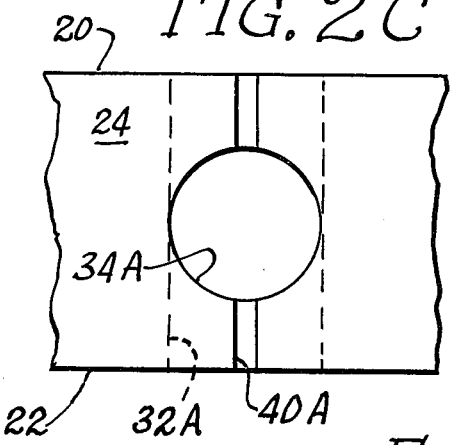
FIG. 2C is a left-hand side elevational view of FIG. 2A.
Figure 2D:
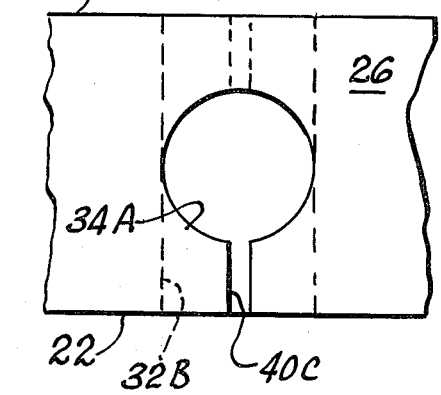
FIG. 2D is a right-hand side elevational view of FIG. 2A.
Figure 6:
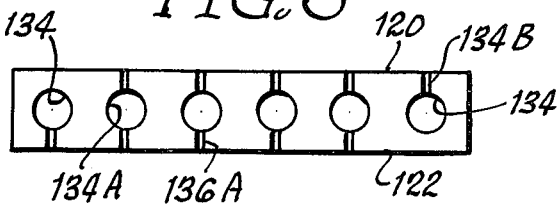
FIG. 6 is a front view of the fabricating member of FIG. 5.

Referring first to FIG. 2, typical bore 32A opens into surfaces 20 and 22. At surface 20 bore 32A communicates with a slit 40A. Slit 40A also opens at surface or side edge 24 for the full height of side edge 24. A further slit 40B opens at surface 20 and opens both into bore 32A and bore 32B thereby serving to provide resiliency for both of bores 32A and 32B. Slit 40B extends downwardly to communicate with hole 34A, but does not extend to surface 22 as is clear from FIG. 2B.

As will be apparent, each of the bores is provided with a slit or slit portion which intersects one or both of the major surfaces 20 and 22. In the case of slit 40A, this intersects both of the major surfaces 20 and 22. In the case of slit 40B this simply extends downwardly from surface 20, but does not extend through surface 22. The reason for this is that if it extended all the way through both of the surfaces, it would tend to weaken the overall structure too substantially. It is also to be noted that there is no slit portion provided on the opposite side of bore 32B at major surface 20, also to prevent the weakening of the overall fabricating member. To provide bore 32B with enhanced resiliency, a slit portion 40C (see FIG. 2B) is provided. Slit portion 40C extends inwardly from side edge 26 to bore 32B. It extends from surface 22, but does not extend clear through to surface 20, terminating in hole 34A.

As will be apparent from FIG. 2, the location of the slit portions may vary. For example, slits 42A and 42B extend inwardly from their respective side edges 26 and 24 for the full distance between surfaces 20 and 22. Accordingly, they open, respectively, into surfaces 20 and 22 as well as side edge 26 (slit 42B) and surfaces 20 and 22 and side edge 24 (slit 42A). To maintain the strength of the member 10, there is no slit portion in surfaces 20 or 22 between bores 32C and 32D, although a slit portion extending between bores 32C and 32D through only one of surfaces 20 or 22 (like slit portion 40B) may be provided. If that were done, then a portion of either slit 42A or 42B, i.e., a portion at surface 22 might well be omitted.

Where a bore intersects with a hole, the slit portions may serve to provide resiliency both for a bore and for a hole. Referring again to FIGS. 2 and 2A–2D, it will be apparent that slit 40A mot only serves to provide resiliency for bore 32A, but also serves to provide resiliency for hole 34A. Slit 40A is seen to extend between surfaces 20 and 22 so that as a cylindrical rod or tube is inserted into the hole, the slit 40A will allow limited resilient expansion of the hole 34A as the complementary cylindrical member is force fit into the hole, thereby firmly to grip the complementary resilient member.

The slit portion 40A also serves to make more resilient the hole 34A when it receives a complementary cylindrical member through side edge 24. When a complementary member is inserted into hole 34A through side edge 26, slit element 40C serves to make the hole 34A resilient.

Where the holes and bores intersect, the holes and bores frequently serve as extensions of the slit portions thereby effectively to lengthen the slits. Thus, for example, the effective length of the slit portion for hole 34A includes, when viewed from side edge 24, slit element 40A, the diameter of bore 32A and slit element 40B. These then comprise an effective slit element which is substantially greater than one-half the length of the hole 34A which is to be made resilient.

Holes 34A are seen to extend across the construction member 10 and between side edges 24 and 26. However, some holes 34 terminate inwardly of construction element 10. Typical of those latter holes are end holes 34B. Holes 34B extend inwardly a distance adequate to receive and hold a complementary, cylindrical, construction member. Holes 34B are provided with intersecting slits, such slit elements 40D which extend from end edge 28 into intersecting holes 34C and intersecting bores 32. The slit portion 40D combined with the diameter of hole 34C effectively serves to provide a slit in excess of half the length of the hole 34B.

In the case of all of the holes and bores in element 10, it will be seen that they are provided with slits and slit elements which serve to make the holes and bores resilient. In many cases, the slit elements or portions are common both to holes and bores and, in some cases, particularly at the end of rectangular elements, the slit portions are common to intersecting holes as well as to holes and bores.

Construction members made in accordance with this invention may have a variety of shapes. They may be rectangular parallelepipeds of different sizes, they may be triangular and they may embody arcuate segments and, therefore, may be semi-circular, quarter-circular, disc-like, etc. In FIG. 1, a typical semi-circular element 14 has been illustrated.

Element 14 provides a pair of major surfaces 120 and 122. It is bordered by a perimeter which comprises a semi-circular, segment 124 and a diametric edge 126. A plurality of bores 132 and a plurality of holes 134 are provided. Bores 132 extend generally perpendicularly through the element 14, opening in surfaces 120 and 122. Holes 134 extend inwardly from the perimeter along axes which are generally parallel to surfaces 120 and 122.

A typical bore 132A is provided with a slit 136A which extends between surface 120 and 122 and which intersects a hole 134A. Therefore, slit 136A effectively extends for the entire length of the bore 132A. However, where desired, such as where strength would be impaired by a slit running the full length of the bore, a slit portion less than the full length of the bore, but in excess of half the length of the bore may be provided, such as is illustrated by slit portion 136B which, combined with the diameter of its associated hole 134 is in excess of half the length of the associated bore 132B.

A typical hole 134A communicates with a slit 138A which extends downwardly from surface 122. In the case of hole 134A, slit 138A extends through surface 120 and through surface 122. However, where a clear through slit would weaken the structural integrity of the member 14 a slit portion extending through only one of the major surfaces may be used. For example, a slit portion 138B is used with hole 134B. The length of slit 138B augmented by the associated diameter of the intersecting bore 132 provides an effective slit portion in excess of half the length of hole 134B. Slit 138B opens at surface 120, but does not open into surface 122.

Figure 5:
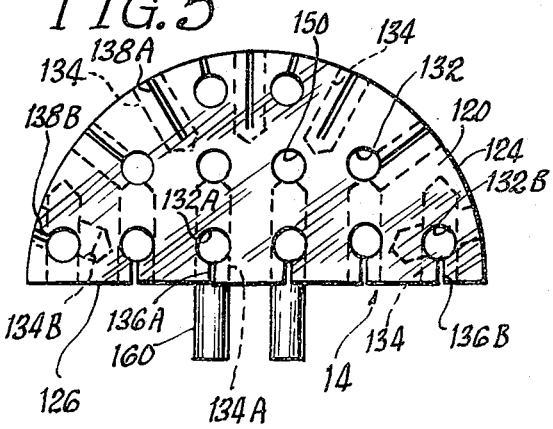
FIG. 5 is an enlarged front view of one of the fabricating members of FIG. 1.

In some cases, holes and bores may be too remote from an edge effectively to utilize the slit arrangement of this invention. In FIG. 5, several typical bores 150 of that character are illustrated. These will not provide all of the advantages achievable through the use of the slits of this invention, but in most cases will be suitably usable. It is clear, however, that the great majority of the bores and holes of member 14 are provided with the slits and slit portions which render the member 14 suitably resilient in accordance with this invention.

A wide variety of configurations may be made with the construction members of this invention. To connect the construction members, various types of connectors may be used. These connectors are generally cylindrical and may be solid rods, hollow tubes or may be tubes or rods which have slotted ends.

In the embodiment of FIG. 1, members 14 and 10 have been illustrated as being connected via short connecting rods 160 (see FIG. 5). Elements 10 and 12 have been illustrated as being connected via flexible tubes 162 and 164. Indeed, tubular element 162 has been bent to connect with element 10, to pass through element 12, through element 10 again and then to be connected at its other end in element 12. The resilient bores and holes make the gripping and retention of the connecting members 162 and 164 more effective.

If is also clear that the overall construction of FIG. 1 is one having a contoured, sculptured appearance providing aesthetic interest. The overall assemblage of elements and connecting elements in accordance with this invention therefore is educational and interesting and provides a challenge to the imagination of the user.

Other members may also be assembled with the construction members of this invention and that is typified by the wheel arrangement in FIG. 1. As there shown, a rod member 170 passes through a hole in member 12 to serve as an axle. Wheels 172 are retained on rod 170 by friction-mounted cylinders 174, which may be slotted as by slots 175 (see FIG. 2), at each side. It will be apparent that other elements may be mounted with and secured to the construction members of this invention to build a wide variety of toys and sculptures.

Yet another construction member in accordance with this invention is illustrated as member 16 in FIG. 1. An elongate version of member 16 is illustrated in FIGS. 7, 8 and 9.

Referring now to FIGS. 7 to 9, a construction member 16A is elongated and generally cylindrical in shape. It defines a plurality of holes 200 and intersecting bores 202 which intersect generally at right angles. Preferably, although it is not necessary, the holes and bores intersect each other at right angles.

Slits 210 extend inwardly from the surface of member 16A downwardly into bores and holes 200 and 202, thereby serving as common slits 210 for making bores and holes 200 and 202 resilient. In the embodiment illustrated, slits 210 extend inwardly from the surface of the cylinder at diametrically opposed points, see FIGS. 8 and 9. At the end of element 16A, a further hole 200 extends inwardly. This hole communicates with an intersecting hole 200 and bore 202 and is provided with a further slit portion 212. Although it may extend diametrically across the width of the entire construction element 16A, preferably it extends inwardly from one side but does not cut through at the opposite diametric side. It will be apparent from FIGS. 7 to 9 that the slits extend at least half the length of the associated hole or bore when the length of the slit is considered to be augmented by the associated respective bore or hole opening.

It will be apparent to those skilled in the art that other parts and assemblages may be made without departing from the spirit and scope of this invention. Accordingly, I intend that my invention shall be limited only in accordance with the appended claims.

What is claimed is:

1. A toy assemblage comprising an assembly of at least two toy construction fabricating members, each defining a plurality of bores extending through said fabricating member and a plurality of holes extending inwardly of said fabricating member, each surface of said fabricating member being penetrated by at least one of said holes or bores, each said fabricating member further defining means to provide for limited resilient expansion of at least some of said holes and bores when members complementary thereto are force-inserted thereinto whereby said force-inserted members are firmly gripped, said means comprising a plurality of bore slits for some of said bores and a plurality of hole slits for some of said holes, each said bore slit extending inwardly from a surface of said fabricating member to a said bore and each said hole slit extending inwardly from a surface of said fabricating member to a said hole, each said slit extending in a plane parallel to the axis of its associated bore or hole and intersecting its associated surface and associated bore or hole along a distance of at least half the length of its associated hole or bore, and a complementary connecting member of a size adapted to be resiliently retained in one of said slit bores or holes of two of said fabricating members.

2. A toy assemblage comprising an assembly in accordance with claim 1 in which said connecting member is flexible and is flexed and is maintained in said flexed condition to present a contoured toy assemblage configuration.

3. A toy assemblage comprising an assembly in accordance with claim 1 in which said holes and bores are generally cylindrical.

4. A toy assemblage comprising an assembly in accordance with claim 1 in which some of said bores and holes intersect generally at right angles.

5. A toy assemblage comprising an assembly in accordance with claim 1 in which said fabricating member defines a pair generally parallel major surfaces through which the bores extend, opening at each of said major surfaces, and a perimeter in which the holes open, said holes having axes lying generally parallel to and between the two major parallel surfaces, said bore slits extending inwardly from said perimeter and said hole slits extending from each of said major surfaces to a said hole.

6. A toy assemblage comprising an assembly in accordance with claim 5, in which said bores and holes are generally cylindrical.

7. A toy assemblaage comprising an assembly in accordance with claim 6 in which said connecting member is flexible and is flexed and is maintained in said flexed condition to present a contoured toy assemblage configuration.

8. A toy construction in accordance with claim 7 in which some of said bores intersect with some of said holes, and at least some of said bore slits and hole slits have portions that are common to a said bore slit and a said hole slit.

* * * * *